United States Patent [19]

Ohno

[11] Patent Number: 4,789,022

[45] Date of Patent: Dec. 6, 1988

[54] PROCESS FOR CONTINUOUS CASTING OF METAL RIBBON

[76] Inventor: Atsumi Ohno, 3-20-3, Jindaiji Moto-machi, Chofu City, Tokyo, Japan

[21] Appl. No.: 171,189

[22] Filed: Mar. 18, 1988

Related U.S. Application Data

[63] Continuation of Ser. No. 925,980, Nov. 3, 1986, abandoned.

[30] Foreign Application Priority Data

Nov. 15, 1985 [JP] Japan ..... 60-254956

[51] Int. Cl.[4] ..... B22D 11/06; B22D 27/04

[52] U.S. Cl. ..... 164/463; 164/479; 164/122.1; 164/124; 164/338.1

[58] Field of Search ..... 164/463, 423, 479, 427, 164/429, 122, 122.1, 124, 338.1

[56] References Cited

U.S. PATENT DOCUMENTS 4,307,771 12/1981 Draizen et al. ..... 164/463
4,515,204 5/1985 Ohno ..... 164/338.1
4,588,015 5/1986 Liebermann ..... 164/463

FOREIGN PATENT DOCUMENTS 59-169651 9/1984 Japan ..... 164/338.1
60-72646 4/1985 Japan ..... 164/122.1
60-87956 5/1985 Japan ..... 164/122.1

*Primary Examiner*—Kuang Y. Lin
*Attorney, Agent, or Firm*—William J. Daniel

[57] ABSTRACT

A metal sheet or ribbon having a unidirectional crystalline structure is produced by continuous casting by the steps of feeding the molten metal to be cast onto the surface of a solidification support moving continuously in one direction along a given path, while heating the solidification support so that the surface thereof at the position for receiving the molten metal is at a temperature exceeding the solidification temperature of the metal being delivered thereto, and then cooling the delivered metal downstream of said position whereby the formation of crystal nuclei upon contact of the delivered molten metal is inhibited and the solid sheet or ribbon has a unidirectional crystalline structure conducive to ease in cold working without cracking.

18 Claims, 3 Drawing Sheets

PROCESS FOR CONTINUOUS CASTING OF METAL RIBBON

This application is a continuation, of application Ser. No. 925,980, filed Nov. 3, 1986, and now abandoned.

BACKGROUND OF THE INVENTION

1. Field of the Invention

This invention relates to continuous casting of a metal ribbon, excelling in ease of fabrication and consisting of a unidirectional solidification structure and characterized by a substantially greater length than diameter or thickness, e.g., in the form of a metal strip or a metal wire.

More particularly, this invention relates to a process for the continuous casting of a metal strip or ribbon by feeding a molten metal onto the structure of a solidification base or support moving generally continuously in one direction at a locus along its path, which process is characterized by preheating the solidification base upstream of the locus for receiving the molten metal to a temperature above the fusion point of the metal, thereby preventing the received molten metal from forming crystal cores or nuclei upon contact with the support surface, and cooling the metal to solid condition on said support surface as the same moves away from the feeding locus conferring upon the resultant solid metal ribbon a unidirectional solidification structure excelling in ease of fabrication.

2. Description of the Prior Art

Recently, the rapid advance of the electronic industry has produced a persistent pressure for reduction in size and improvement of accuracy in machines and implements used therein. Along with this pressure, metal materials used therefor have been expected to fulfill their function satisfactorily with increasingly small thickness or width and increasingly exacting quality. To be specific, there has developed a need for fine lines and thin sheets and foils made of a metallic material possessing a unidirection solidification structure devoide of gross porosity, bubbles, or crystal grain boundaries which are liable to collect deposits of impurities.

It is generally known that when a metal ribbon is subjected to cold working, such as cold rolling or cold drawing, it undergoes work hardening and eventually fractures along primary crystal grain boundaries which were formed during the course of solidification of the metal ribbon. It is, therefore, highly desirable that metal ribbon serving as the starting material for an extremely fine line or an extremely thin sheet or foil should possess a texture free of primary crystal grain boundaries which are liable to initiate the generation of cracks by such working as described above.

This invention aims to provide a process capable of continuously producing a metal ribbon possessing a unidirectional solidification structure readily adapted for working as by rolling or drawing and containing no internal defects such as gross porosity and bubbles, by an extremely simple operation of feeding a molten metal via a nozzle onto the surface of a solidification base or support being continuously moved in one direction.

Heretofore, a metal strip has been widely produced for the manufacture of amorphous ribbon by continuously feeding molten metal from a nozzle to the surface of a cooled solidification base or support in the shape of a cylinder or drum being rotated in one direction thereby allowing the molten metal to be suddenly cooled and solidified. The same method is also now used generally for the manufacture of thin metal strip in addition to the aforementioned amorphous metal ribbon. The metal strip obtained in this way, however, has a polycrystalline form because the molten metal forms crystal cores or nuclei on contact with the surface of the cooled solidification support. Moreover, the crystals so produced are liable to grow in parallel directions substantially perpendicularly to the surface of the solidification support. Since the metal strip in polycrystalline form is liable to sustain cracks along crystal grain boundaries while being worked, manufacture of a very thin foil and fabrication into an extremely slender line has been attained only with great difficulty. Particularly, a strip of an alloy having a wide solidification temperature range is very likely to sustain cracks along crystal grain boundaries. It has been found difficult, therefore, to attain smooth separation of the strip of this alloy from the curved solidification support without creating cracks in the strip.

SUMMARY OF THE INVENTION

Totally unlike the conventional method which produces a metal strip of polycrystalline form by feeding molten metal onto the surface of a cooled solidification support in the shape of a cylinder being rotated in one direction thereby allowing the molten metal to solidify on contact with the surface, the present invention is directed to a process for producing a metal ribbon having a unidirectional solidification structure and excelling in ease of working by maintaining the surface of the solidification support at a temperature above the metal melting point, thereby preventing the molten metal from forming crystal nuclei upon contact with the support surface.

Other objects and characteristics of the present invention will become more apparent from the description set forth in further detail hereinbelow with reference to the accompanying drawings.

DETAILED DESCRIPTION OF THE INVENTION

Figure 1:
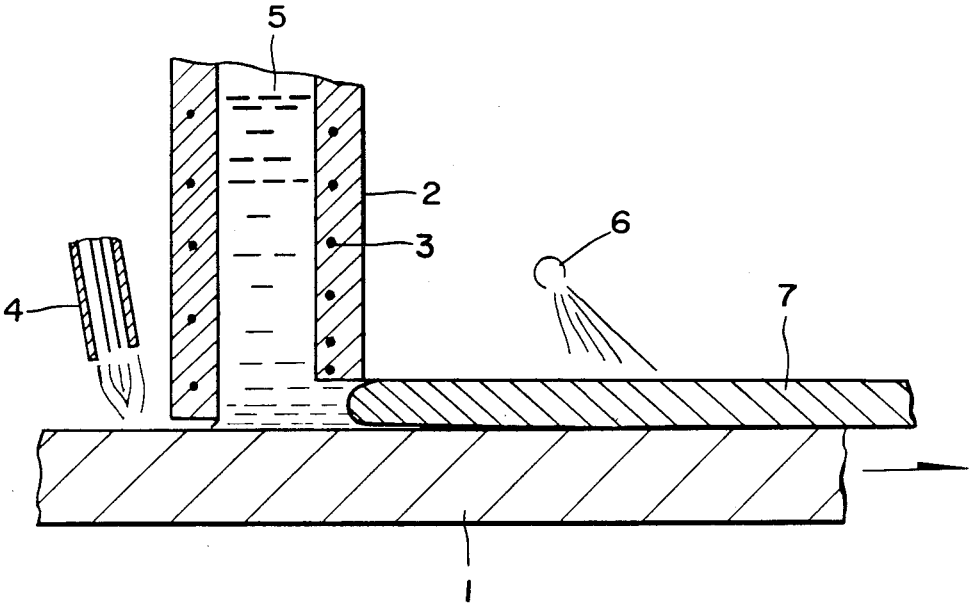
FIG. 1 is an explanatory diagram of the principle of the process of this invention.

More specifically, this invention concerns a process for easily continuously producing a metal ribbon with a unidirectional solidification structure by moving a solidification support continuously in one direction, preheating the surface of the solidification support so that it is at a temperature above the metal melting point at the point of delivery thereto of molten metal, feeding the molten metal to the surface of the solidification support, and subsequently allowing the delivered molten metal to be cooled as the surface moves away from the metal delivery point.

The term "solidification support" as used herein means a device having a surface adapted to receive and solidify molten metal delivered thereto. For the production of a metal strip, the solidification support may be in the shape of a elongated flat smooth plate, a roller, or an endless belt. For the production of a metal line or wire, the solidification support may be in the shape of an elongated flat smooth plate, a roller, or an endless belt. For the production of a metal line or wire, the solidification support may take the form of a mold provided with one or more grooves or a cylinder provided on its periphery with one or more grooves.

Now, the principle of the present invention will be described with reference to FIG. 1. In an apparatus illustrated in FIG. 1, a solification support 1 is made of graphite, a refractory material, or high melting metal and adapted to be moved at a fixed speed in the direction of the arrow. A nozzle 2 is used for the delivery of a molten metal onto support 1, being connected to a molten metal supply container (not shown). A heater means 3 is used for heating the nozzle 2 and is made of an electric resistance heating element or a high-frequency induction coil. The outlet of the nozzle 2 is always kept at a temperature exceeding the solidifying temperature of the casting metal. A heater 4 such as a gas burner is used for heating the surface of the solidificationsupport upstream of nozzle 2 and may be made of a resistance heating element, a high-frequency induction coil, or an electron beam. Molten metal 5 is continuously supplied from the molten metal supply container to the interior of the nozzle 2. By 6 is denoted a cooling water spray. Optionally, the cooling may be effected by using cooling gas or mist. Denoted by 7 is a solid metal ribbon carried away on support 1.

Now, the solidification support 1 is kept moving in the direction of the arrow, and the gas burner 4 is arranged to heat its surface to a temperature exceeding the solidification temperature of the casting metal. When the molten metal emerging from the nozzle 2 is delivered to the support surface and is cooled by the cooling water spray 6, the crystals of the metal ribbon 7 grow preferentially in the direction of length of the metal ribbon, so that a unidirectional solidification structure results in the produced metal ribbon.

The solidification front of the metal ribbon 7, i.e., the solidus-liquidus interface, is always located in the gap between the egress side of nozzle 2 and the solidification support 1 as illustrated in FIG. 1. The metal strip is allowed to acquire a perfect unidirectional solidification structure entailing the formation of no new crystal nuclei from the lateral sides thereof by keeping the temperature of the surface of the solidification support 1 under the nozzle above that of the metal strip contacting the aforementioned surface and adjusting the temperature of the molten metal, the nozzle, and the support surface.

Figure 2:
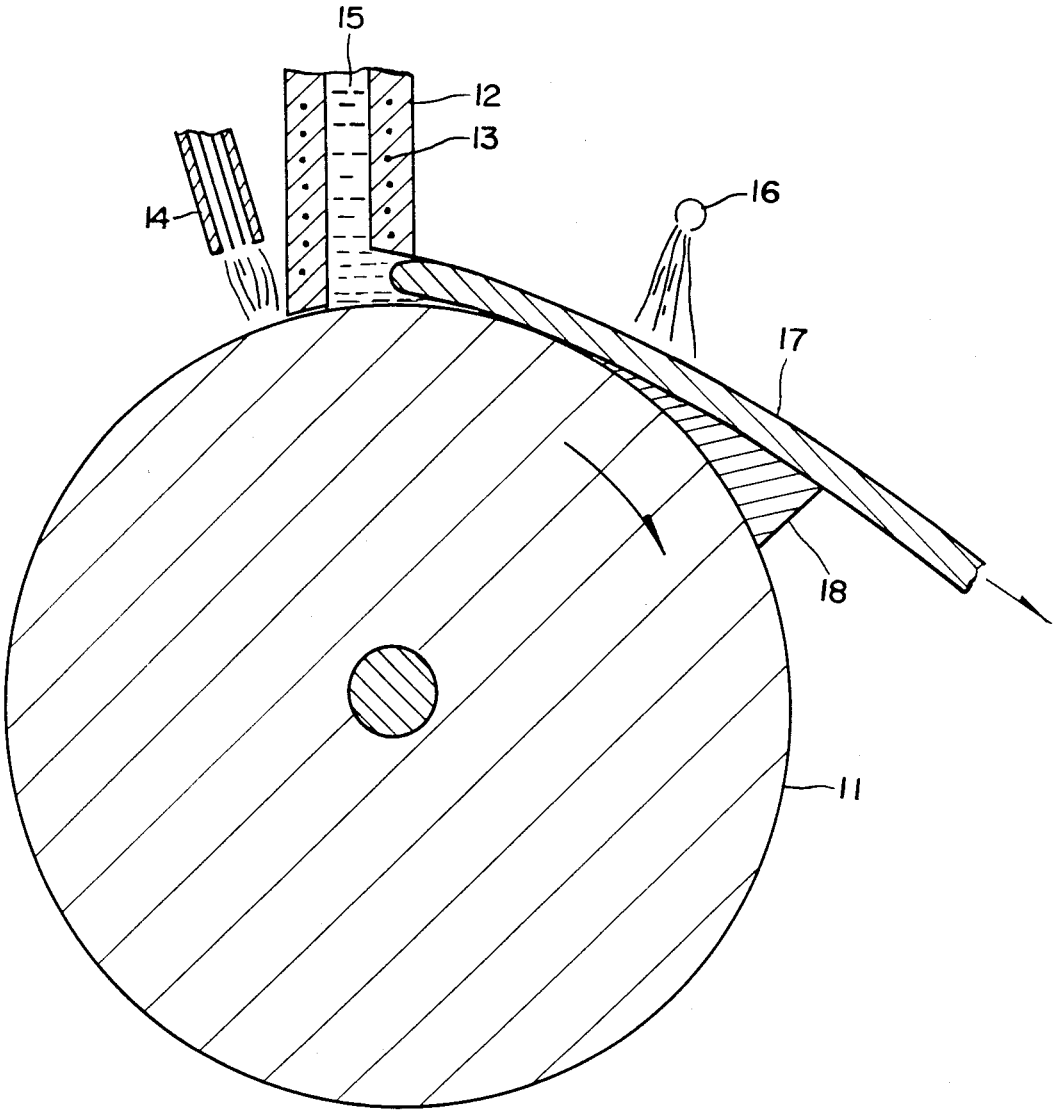
FIG. 2 is a longitudinally sectioned side elevation illustrating the essential part of a typical apparatus for the continuous casting of a metal strip having a unidirectional solidification structure, using a cylinder as the solidification surface.

FIG. 2 is a longitudinally sectioned side elevation of the essential part of a typical apparatus for the production of a metal strip having a unidirectional solidification structure, using a cylinder as a solidification support in accordance with the principle of the present invention.

In the apparatus illustrated in FIG. 2, the solidification support 11 is in the shape of a cylinder and is adapted to rotate in the direction of the arrow. A nozzle 12 used for supplying molten metal is kept heated by a heating means 13 to a temperature exceeding the solidification temperature of the casting metal. A gas burner 14 is adapted to heat the surface of the solidification support 11 at the site of the delivery of the molten metal to a temperature exceeding the solidification temperature of the casting metal. By 15 is denoted molten metal, by 16 a cooling water spray, and 17 the cast solidified metal strip. A knife 18 serves to separate the metal strip 17 from the solidification support 1.

The molten metal which is supplied from the nozzle 12 to the heated surface of the solidification support 11 is preferentially solidified at the leading end of the metal strip 17 and allowed to form a unidirectional solidification structure. The consequently solidifed metal strip, therefore, can be separated from the surface of the solidification support 11 without causing cracking by the knife 18, to be taken up on a roll (not shown).

Figure 3:
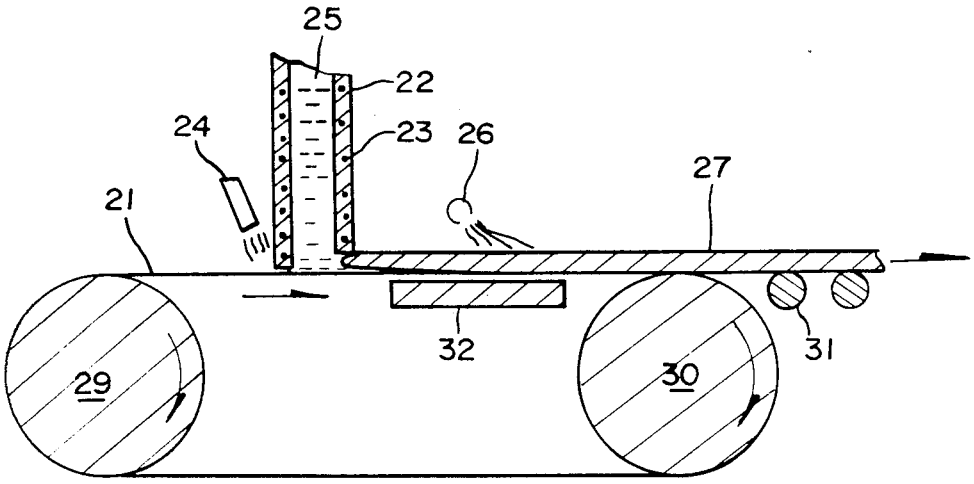
FIG. 3 is a longitudinally sectioned side elevation illustrating the essential part of a typical apparatus for the continuous casting of a metal strip having a unidirectional solidification structure, using an endless belt as the solidification support.

FIG. 3 is a longitudinally sectioned side elevation of the essential part of an apparatus for the production of a metal ribbon according to the principle of the present invention, utilizing an endless belt as the solidification support. Thus, solidification support 21 is in the form of an endless metallic belt and is provided on the surface with a refractory coating which serves to protect the surface of the belt against reaction with the molten metal. By means of rollers 29, 30, the metallic belt can be moved in the direction of the arrow. A gas burner 24 heats the metallic belt 21. Molten metal 25 supplied from a nozzle 22 to the heated metallic belt 21 is preferentially solidified at the leading end of a metal ribbon 27 which is kept cooled by a cooling water spray 26. The metal ribbon 27 is advanced on guide rolls 31 to be taken up by a winding machine (not shown). By 32 is denoted a support stand for the belt. Optionally, it may be replaced with guide rolls.

Figure 4:
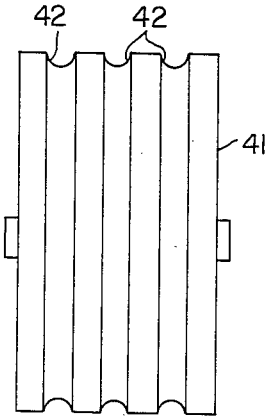
FIG. 4 is a front elevation of a cylindrical solidification structure provided with a plurality of peripheral grooves thereon for the casting of a metal line or wire in accordance with the method of this invention.

FIG. 4 shows in front elevation a solidifcation surface suitable for the continuous casting by means of the inventive process of thin lines or wires of the cast metal, such surface being shown separately from the remainder of the apparatus. The surface is shown in the form of a cylinder 41 provided on its periphery with three parallel grooves 42 for the reception of the cast metal.

In the process of this invention, the formation of new crystal nuclei in the molten metal on contact with the surface of the solidification support is completely precluded by the heating of the surface of the solidification base, the number of crystals initially forming in the metal ribbon being decreased through competition for growth as the casting of the metal ribbon proceeds. Thus, the crystals tend to form a single crystal eventually. This invention, therefore, provides not only a process suitable for the production of a metal ribbon possessing a unidirectional solidification structure but also a process capable of readily producing a metal ribbon formed of a single crystal. Further in continuous casting of an alloy with an eutectic composition, the process of the present invention can easily produce a metal ribbon of a structure composed of columnar eutectic crystals regularly arrayed in one direction or a structure composed of a single eutectic crystal.

In carrying out the present invention, to avoid giving the molten metal a chance to form crystal cores, the heated nozzle must be kept as close to the surface of the solidification base as possible. Further, the rate at which the metal ribbon is cooled must be adjusted so that the temperature of the surface of the solidification support at the solidification front of the metal ribbon should be kept from dropping below the solidification temperature of the casting metal.

As the material forming the surface of the solidification support to be used in practicing the process of this invention, a substance incapable of reacting with the molten metal can be selected from among heat-resistant rubber, graphite, refractory substances, and heat-resistant metals such as stainless steel where the metal ribbon is made of a low melting metal such as tin or lead alloy. Where the metal ribbon is made of a high melting metal such as aluminum, copper, or iron alloy, a refractory substance incapable of reacting with the fused oxide of the metal forming the metal ribbon can be selected from among such refractory substances as silicon carbide, silicon nitride, boron nitride, alumina, magnesia, and zirconia. For effective use in the process of this invention, the solidification support is only required to comprise a carrier made of metal and a coating deposited on the surface of the carrier and made of a refractory substance incapable of reacting with the molten metal. Particularly where the solidification support is to be constructed in the form of an endless belt, a metallic belt provided with a coating of a refractory substance or carbon incapable of reacting with the molten metal can be used advantageously to prevent the otherwise possible seizure of the metal ribbon by the endless belt.

In the production of a metal ribbon having a high melting point, for the purpose of preventing the metal from fusion or the molten metal from oxidation during its delivery, it suffices to keep the nozzle orifice surrounded and protected, when necessary, with an inert gas such as argon or nitrogen or with a reducing gas such as hydrogen or carbon monoxide.

For the purpose of heating the nozzle and the solidification support, a low resistance heating element such as, for example, nichrome or silicon carbide can be used where the metal ribbon is to be formed of a low melting metal such as tin, zinc, or lead or alumina. Where the metal ribbon is to be formed of a high melting metal, a high resistance heating element such as tantalum, tungsten, molybedenum, platinum, or silicon carbide can be used. As heating means, a high-frequency induction heating coil, a gas burner, or an electron beam heater can be used.

The solidification front of the metal ribbon of a unidirectional solidification structure obtained by the process of this invention is prevented from forming crystal nuclei on contact With the surface of the solidification support by keeping the surface of the support beneath the leading edge of the nozzle heated to a temperature above the solidification temperature. As the result, the cast metal ribbon is allowed to acquire a perfect unidirectional solidification structure. Thus, the metal ribbon enjoys high quality free from such defects as fine gross porosity, gas bubbles, and macroscopic melt segregation. This invention, therefore, may well be regarded as an epochal means of producing, by a simple procedure and with great facility, material such as magnetic materials which need to possess a unidirectional solidification structure and very thin foils and very slender threads or wires.

The process of this invention readily eliminates such casting defects as gross porosity and gas bubbles which are inevitably suffered by the conventional casting method. When the molten metal entrains any non-metallic substance, this substance is contained in the produced metal ribbon. For the final metal ribbon to enjoy high quality free from such foreign matter, the foreign matter should be removed from the molten metal in a proper manner before the solidification. For this purpose, it is necessary that the molten metal should be passed through a refractory metal gause or a porous ceramic filter either inside the nozzle or at a point preceding the nozzle.

To the nozzle, the molten metal melted in advance, in the molten metal supply container and kept at a fixed temperature therein can be continuously supplied at a fixed adjusted feed volume under an increased or decreased pressure. Otherwise, the metal in the form of powder or a rope may be supplied into the nozzle and melted therein and subsequently fed to the solidification support.

The width and the thickness of the metal ribbon can be freely changed by suitably varying the width of the opening end of the nozzle and the distance between the nozzle and the solidification support.

Now, the present invention will be described more specifically below with reference to a working example.

EXAMPLE

In an apparatus constructed as illustrated in FIG. 1, molten Cu was fed to an alumina nozzle having an inside diameter of 3 mm at the leading end thereof and heated to 1,100° C. The nozzle was disposed so that the leading end thereof is kept at a distance of 1 mm from the upper surface of an aluminum solidification support of the shape of a strip 30 mm in width and 2,000 mm in length. This solidification support was moved at a rate of 200 mm/min in the direction of a cooling device. At this time, the surface of the molten metal advancing in the form of a layer from the nozzle on the surface of the solidification support was cooled with argon gas cooled to 5° C. and blown at a rate of 10 lit./min. obliquely in a direction away from the nozzle.

When the surface of the resultant metal ribbon was etched and the exposed texture of the metal ribbon was observed, it was found to be a perfect unidirectional solidification structure. The results indicate that the process of this invention is highly effective in producing a metal ribbon of unidirectional solidification structure.

This invention provides a process capable of casting a metal ribbon of small diameter or slight thickness enjoying satisfactory workability directly from molten metal by a very simple operation of feeding the molten metal to the solidification support being moved in one direction. Even from the standpoint of energy and labor saving, this is literally an epochal and economically valuable process.

While the present invention has been described by way of specific embodiments, it is to be understood that numerous changes and modifications may be made therein without departing from the spirit and scope of the invention as defined in the appended claims.

What is claimed is:

1. A process for the continuous casting of a metal ribbon having unidirectional solidification structure which comprises the steps of moving slowly and continuously in one direction along a given path, an elongated solidification support having a surface adapted to receive molten metal thereon; flowing a thin stream of molten metal onto said moving support surface at a locus along said support path; heating said surface upstream of said locus so that the temperature of said surface while passing through said locus is above the melting point of said metal flowed thereon; and while said metal stream is supported on said support, contacting its exposed surface opposite said support downstream of said locus with a cooling medium to cool the metal moving with the surface to solidify the same, whereby the creation of crystalline nuclei in the metal stream upon contact with said support surface is inhibited.

2. A process according to claim 1, wherein said solidification support is made of a refractory ceramic, metal, graphite, or heat-resistant rubber.

3. A process according to claim 1, wherein said solidification support is made of metal coated with a refractory substance.

4. A process according to claim 1, wherein said solidification support has a generally flat surface at said locus for receiving said molten metal.

5. A process according to claim 4, wherein said solidification support carries at least one groove for receiving said molten metal.

6. A process according to claim 1, wherein said solidification support moves in an endless path.

7. A process according to claim 6, wherein said endless support has at least one groove formed in its peripheral surface in the direction of its movement for receiving said molten metal layer.

8. A process according to claim 1, wherein said solidification base is an endless belt or a cylinder.

9. A process according to claim 1, wherein said molten metal stream is fed to said support surface by a nozzle and at least the outlet of said nozzle is maintained at a temperature exceeding the solidification temperature of the molten metal.

10. The process according to claim 9 wherein said cooling medium cools said metal stream to form thereon a generally stationary solidification front proximate to said nozzle and said solidification support at the locus of said solidification front is maintained at a temperature above the solidification temperature of the molten metal.

11. A process according to claim 1, wherein said nozzle includes a downstream edge spaced above said support surface and defining a gap for egress of metal flowed onto said moving surface and the solidification front of said solid metal is located within said gap.

12. A process according to claim 1, wherein said molten metal is maintained under an atmosphere of non-oxidizing gas.

13. A process according to claim 1, wherein said solid metal is formed of a single crystal.

14. A process according to claim 1, wherein said solid metal is formed of at least one eutectic crystal.

15. A process according to claim 9, including the step of filtering said molten metal for removal of foreign matter before feeding the same by said nozzle.

16. A process according to one claim 9, wherein said nozzle is heated by a high-frequency induction coil.

17. A process according to claim 1, wherein said solidification support is heated by a gas burner, an electron beam or a high frequency induction coil.

18. A process according to claim 1, wherein said nozzle and said support surface are made of material non-reactive with said molten metal.

* * * * *